United States Patent [19]

Cable

[11] Patent Number: 4,800,592

[45] Date of Patent: Jan. 31, 1989

[54] COSTUME WITH COMPRESSIBLE ARMS AND LEGS

[76] Inventor: Jon S. Cable, 319 N. 46th St., Phoenix, Ariz. 85008

[21] Appl. No.: 114,434

[22] Filed: Oct. 28, 1987

[51] Int. Cl.[4] ..... A41D 3/00

[52] U.S. Cl. ..... 2/69; 2/4; 2/22; 2/46; 2/59; 2/126; 2/227

[58] Field of Search ..... 2/69, 4, 46, 2.5, 2.1 R, 2/22, 227, 59, 126; 36/2 R, 1.5

[56] References Cited

U.S. PATENT DOCUMENTS

| | | | |
|---|---|---|---|
| 1,004,507 | 9/1911 | Walz | 2/4 |
| 1,096,607 | 5/1914 | Deray | 2/2.1 R X |
| 1,430,194 | 9/1922 | Schweinert | 2/2.1 R |
| 1,930,748 | 10/1933 | Giorda | 36/2 R |
| 2,244,871 | 6/1941 | Guinzburg | 2/22 X |
| 3,329,967 | 7/1967 | Martinez et al. | 2/2.1 R |
| 3,381,303 | 5/1968 | Hazard | 2/2.1 R |
| 3,582,989 | 6/1971 | Fassbender | 2/4 |
| 3,758,963 | 9/1973 | Knight | 36/2 R |
| 3,783,451 | 1/1974 | Malin | 2/4 |

*Primary Examiner*—H. Hampton Hunter
*Attorney, Agent, or Firm*—Louise S. Heim

[57] ABSTRACT

A costume includes a pair of arm pieces, a pair of leg pieces, and an optical hood, each of which is made from a compressible tubular conduit including a helically wound coil of resiliently flexible wire material and a covering material for encasing the wire material. The arm pieces are connected together by an adjustable strap which extends over the wearer's back. The leg pieces include hooks for securing over the wearer's pants. Both the arm and leg pieces include end caps with small diameter openings for closely encircling the wearer's wrists and shins, respectively, thus preventing the coil of flexible wire material in each piece from extending beyond the length of the wearer's arms of legs.

17 Claims, 1 Drawing Sheet

COSTUME WITH COMPRESSIBLE ARMS AND LEGS

BACKGROUND OF THE INVENTION

1. Field of the Invention

This invention relates in general to clothing and, more particularly, to a Halloween or theatrical costume having compressible arms and legs.

2. Description of the Prior Art

There has always been a great demand in the costume industry for innovative costumes which appeal to the imaginations of individuals of all ages and at the same time are relatively comfortable, inexpensive and easy to manufacture. In the past, the demand was primarily for ghoulish-type costumes such as witches, ghosts, devils and the like, or for animals or historical figures. In recent years, however, the public's increasing fascination with high technology has led to a greater demand for "space-age" costumes which utilize new materials and which are futuristic in appearance. Typically, these costumes depict such characters as astronauts, robots, androids and various beings, both human and non-human, from popular science fiction books, movies and television programs. Unfortunately, most of these costumes have been rather complex and expensive to manufacture, and in addition have been rather bulky and unwieldy to wear, restricting the wearer's freedom of movement and resulting in considerable discomfort. Furthermore, it is generally necessary to provide the costumes in a number of different sizes to accommodate different individuals, which adds still more to the cost of manufacture.

Therefore, a demand exists for a new and improved, futuristic costume which overcomes some of the deficiencies of the prior art.

SUMMARY OF THE INVENTION

In accordance with the present invention, a new and improved costume is provided with tubular arms and legs made from resiliently compressible material. More specifically, the costume includes a plurality of tubular conduits, each of which comprises a helically wound wire of spring-like material encased in a two-ply covering of plastic, fabric or foil A complete costume preferably includes four tubular conduits, two of which constitute arm pieces and two of which constitute leg pieces. The two arm pieces are held in place by means of an adjustable strap which extends across the wearer's back and connects the two pieces together. The leg pieces are held in place by means of hooks which are riveted or otherwise secured to the top edge of each leg piece and fastened to the wearer's belt or waistband.

The distal end of each of the arm and leg pieces is closed off by an end cap with a smaller diameter opening for closely encircling one of the wearer's wrists or shins, respectively. Each of the caps acts essentially as a stop for preventing the spring wire in the tube from extending beyond the length of the wearer's arm or leg. Thus, the resilient, compressible nature of the tubes allows a single, uniform length to be used regardless of the size of the wearer. The same length tube could be worn, fully extended, by an adult or, fully compressed, by a child, although it might be desirable to provide at least two sizes in order to accommodate for extremes. Only the diameters of the end cap opening would have to be varied to fit over wrists and ankles of different dimensions.

Accordingly, it is an object of this invention to provide a new and improved futuristic costume having arm and leg pieces made from resilient, compressible tubing material.

Another object of the invention is to provide a "space-age" costume which is relatively comfortable to wear and does not limit the wearer's freedom of movement.

Still another object of the invention is to provide a costume using readily available, easily manufactured and inexpensive materials.

Yet another object of the invention is to provide a costume using compressible tubing which enables a single size to be worn individuals of various different heights.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
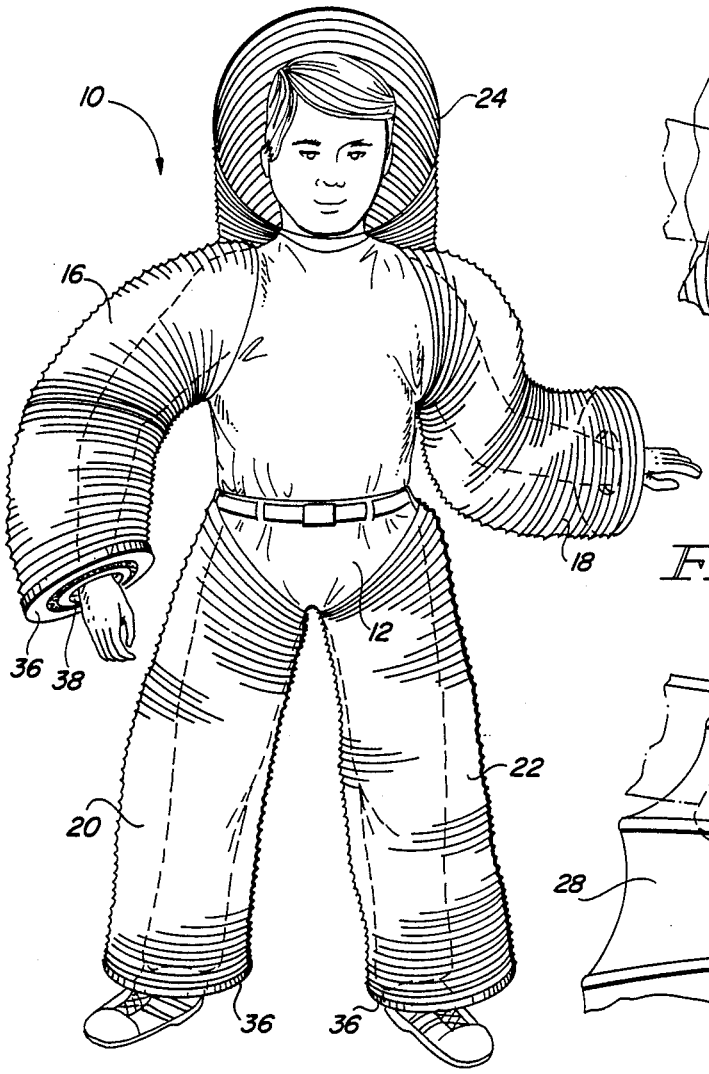
FIG. 1 is a perspective view showing the costume of the present invention.
Figure 2:
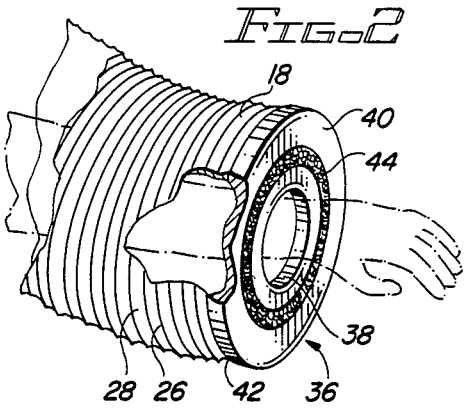
FIG. 2 is an enlarged fragmentary view, partially broken away, showing one of the armpieces of the costume shown in FIG. 1.

Referring more particularly to the drawings, FIG. 1 shows the costume of the present invention, indicated in its entirety by the numeral 10. For the sake of clarity and convenience, the costume 10 is shown being worn over conventional street clothes (i.e. pants 12 and a shirt 14), with the wearer's torso area left essentially uncovered. However, in actual use, it is preferred that a suitable jacket, sheath, tunic or the like be worn over the wearer's torso to obscure the fastener elements which secure the costume to the wearer's body, and to provide a look of aesthetic continuity with the rest of the costume.

Figure 3:
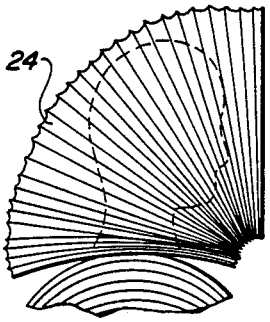
FIG. 3 is a fragmentary side view showing a hood used with the costume of the present invention.

The costume 10 preferably comprises a plurality of resilient, compressible tubular conduits, including two arm pieces 16, 18 and two leg pieces 20, 22. A fifth, tubular conduit, shorter in length than the arm and leg pieces 16, 18, 20, 22 may also be provided for use as a hood 24 as shown in FIG. 3. The hood 24 is regarded as an optional accessory of the costume which may be replaced with other headgear such as a helmet (not shown) or simply eliminated altogether.

Each of the conduits which constitute the arm and leg pieces 16, 18, 20, 22 of the costume comprises a helically wound wire of spring steel 26 or similar resilient material which is encased or embedded in a two-ply covering 28 of plastic, fabric, foil or the like. Tubing of this type is commonly used in various types of fluid conveyer systems, particularly in air conditioning ducts, and is readily available from distributors of air handling products, such as Williams Bachman Distributing Company, Inc. of Phoenix, Ariz.

Figure 4:
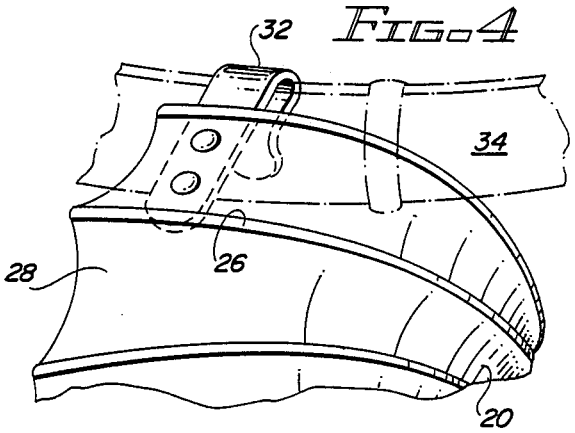
FIG. 4 is an enlarged fragmentary view showing an arrangement for fastening one of the leg pieces to the wearer's clothing.
Figure 5:
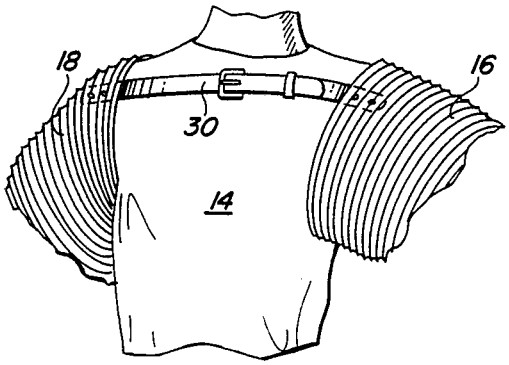
FIG. 5 is a fragmentary back view showing an arrangement for strapping the armpieces across the wearer's back.
Figure 6:
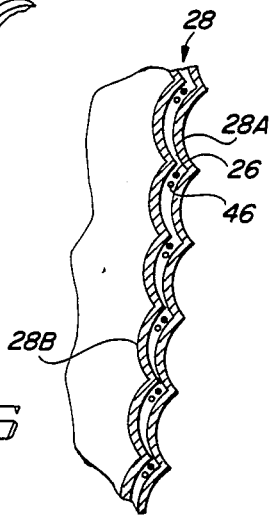
FIG. 6 is an enlarged fragmentary sectional view taken through the tubing used in one embodiment of the invention.

Each of the tubular conduits 16, 18, 20, 22 includes a large diameter opening at one end, through which the wearer extends his or her arms or legs, respectively. Fastening means are provided proximate each of the large diameter openings for securing the tubes over the wearer's body. In the case of the arm pieces 16, 18, the fastenaing means comprises an adjustable strap 30 which extends across the wearer's back and connects the two arm pieces 16, 18 together as shown in FIG. 5, the strap 30 is shown here as being fastenable by means of a conventional belt buckle arrangement but it may also be provided with other arrangements such as interconnectable hook and loop fasteners of the type sold under the trade name "Velcro". In the case of the leg pieces 20, 22, the fastening means preferably comprises a pair of hooks 32 (only one shown), each of which is riveted or otherwise secured to the top edge of a different one of the leg pieces 20, 22 and fastened to the waistband or belt 34 of the wearer's pants 12, as shown in FIG. 4. Preferably, as mentioned earlier, a jacket, sheath, tunic or the like (not shown) would be worn over the wearer's torso, to hide the fastening strap 30 and hooks 32 from public view.

At the other end of each of the arm and leg pieces 16, 18, 20, 22 opposite the large diameter opening and fastening means 30, 34, there is provided an end cap 36 which defines a smaller diameter opening 38 for closely encircling one of the wearer's wrists or shins, respectively. Each of the end caps 36 comprises a planar surface 40 which extends transversely with respect to the longitudinal extent of the arm or leg piece, and a cylindrical side wall 42 which fits over the outside perimeter of the piece. The cylindrical sidewall 42 of each end cap 36 prevents the edge of outer covering 28 of each tubular conduit from fraying and the spring wire 26 from unraveling, while the planar surface 40 acts essentially as a stop for preventing the spring wire 26 in the tube from extending beyond the length of the wearer's arm or leg. Thus, the resilient, compressible nature of the tubes allows a single, uniform length of conduit be used regardless of the size of the wearer. The same length conduit could be worn, fully extended, by an adult or fully compressed, by a child, although it might be desirable to provide at least two sizes in order to accommodate for extremes. Only the diameters of the opening 38 in the end caps 36 would have to be varied to fit over wrists and ankles of different dimensions.

The costume 10 may be accessorized or customized an unlimited number of ways to appeal to a wide variety of individuals. Conversely, a number of identical costumes may be provided for a couple or a group of individuals linked together to form a single unit. This may be done simply by providing demountable fasteners such as mating rings of "Velcro" 44 on the planar surface 40 of the end cap 36 on each arm piece 16, 18. Alternatively, a single lunitary armpiece twice the length of an ordinary armpiece could be "shared" by two individuals standing hand in hand. Thus, each wearer may stand with outstretched arms linked to the outstretched arms of his or her neighbors, to form a human chain. A visually intriguing oscillating effect may be achieved when the members of the chain move their arms in unison, and other effects may be obtained when the members walk or dance together. A single individual may also use the Velcro fasteners to link his own two arms together in front of him somewhat in the manner of a monk in prayer.

As mentioned earlier, the compressible tubular conduits which make up the arm and leg pieces 16, 18, 20, 22 of the costume are generally available ready-made from distributors of air handling products. The ready-made conduits are available in a variety of different diameters, the most common of which include 8" diameter tubes and 12" diameter tubes, with the 12" diameter tubes believed to be the most suitable for use in the costume 10 of the present invention. In addition, the two-ply covering 28 of the conduits is available in various different materials including reflective, silver-colored plastic material such as "Mylar", or in transparent material such as cellophane or the like. Furthermore, in addition to manufacturing the costume 10 from ready-made air conditioning conduits, the conduits could also be custom-made especially for use in the costume, thereby extending the range of materials which could be used. For instance, in one embodiment of the costume 10, the outer ply 28A of the covering 28 could be transparent, while the inner ply 28B would be opaque. During the process of manufacturing the conduit, a helically wound hollow flexible tube 46 could be embedded between the two layers 28A, 28B together with the spring wire 46. Some time before the costume is worn, this tube could be filled with a brightly colored, luminescent liquid such as the material which is sold under the trademark "Cyalume" by American Cyanamid Company of Wayne, N.J. 07470. Other fluorescent products, or even strings of conventional electrical lights could also be used to make the costume glow.

Other materials which could be used in the covering 28 of the costume 10 include denim, army camouflage material, black vinyl or "Mylar" which has been anodized or dyed to produce one or more bright, "psychedelic" colors of the wearer's choosing. Alternatively, a transparent covering 28 could be used, and the interior of the costume 10 could be filled with objects such as balloons. Yet another interesting effect may be achieved by utilizing concentric conduits (not shown)–for instance an 8" diameter tube within a 12" diameter tube, with the outermost tube being transparent and the inner tube opaque.

Still more variation in the costume may be achieved by changing the lengths of the tubular conduits. For instance, it is not necessary that the leg pieces 20, 22 extend the full length of the wearer's legs, but instead they could be worn as 37 bloomers" or shorts for a more humorous effect. Obviously, in this case, the small diameter opening of the end cap 36 of the leg piece would be dimensioned to closely encircle one of the wearer's thighs rather than a shin.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

I claim as my invention:

1. A costume to be worn by an individual over conventional street clothes, said costume comprising:

(a) a plurality of compressible tubular conduits, each of said conduits defining a large diameter opening for loosely encircling a limb of said individual and including, I. a helically wound coil of resiliently flexible wire material, and II. a covering material for encasing said coil of wire material;

(b) an end cap provided on one end of each of said tubular conduits opposite said large diameter opening, said end cap comprising a planar surface which extends transversely with respect to the longitudinal extent of said conduit, said planar surface acting essentially as a stop for preventing said coil of wire material from extending beyond the length of said limb, said planar surface further defining a small diameter opening for closely encircling said limb; and (c) fastening means attached to each of said tubular conduits for securing said conduits over said individual's body.

2. The costume of claim 1, in which said plurality of compressible conduits comprises a pair of arm pieces for wearing on the arms of said individual.

3. The costume of claim 11, in which said fastening means comprises adjustable strap means for extending across the individual's back and connecting said arm pieces to one another.

4. The costume of claim 1, in which said plurality of compressible conduits comprises a pair of leg pieces for wearing on the legs of said individual.

5. The costume of claim 4, in which said fastening means comprises a hook secured to one end of each conduit proximate said large diameter opening for attaching each of said leg pieces to the conventional street clothes worn by said individual.

6. The costume of claim 1, in which said plurality of compressible tubular conduits includes a hood piece for being worn over the head of said individual.

7. The costume of claim 1, in which said covering material comprises a reflective, silver-coated material.

8. The costume of claim 1, in which said covering material is transparent.

9. A costume to be worn by an individual over conventional street clothes including pants and a shirt, said costume comprising:

(a) a pair of arm pieces, each of said arm pieces including,

I. A large tubular conduit defining a large diameter opening for loosely encircling an arm of said individual, said conduit being formed from a helically wound coil of resiliently flexible wire material and a covering material for encasing said coil of wire material, and II. an end cap provided on one end of said arm piece opposite said large diameter opening, said end cap including, (i) a planar surface which extends transversely with respect to the longitudinal extent of said arm piece, said planar surface acting essentially as a stop for preventing said coil of wire material from extending beyond the length of said individual's arm, said planar surface further defining a small diameter opening for closely encircling said individual's wrist, and (ii) a cylinderical sidewall extending over the outer perimeter of said conduit for preventing the said covering material of said conduit from fraying and said coil of wire material from unraveling;

(b) a pair of leg pieces, each of said leg pieces including,

I. a compressible tubular conduit defining a large diameter opening for encircling a leg of said individual, said conduit being formed from a helically wound coil of resiliently flexible wire material and a covering material for encasing said coil of wire material, and II. an end cap provided on one end of said leg piece opposite said large diameter opening, said end cap including, (i) a planar surface which extends transversely with respect to the longitudinal extent of said leg piece, said planar surface acting essentially as a stop for preventing said coil of wire material from extending beyond the length of said individual's leg, said planar surface further defining a small diameter opening for closely encircling one of said individual's shins, and (ii) a cylindrical sidewall extending over the outer perimeter of said conduit for preventing said covering material of said conduit from fraying and said coil of wire material from unraveling; and (c) fastening means attached to each of said arm pieces and leg pieces for securing said arm pieces and leg pieces over said individual's body.

10. The costume of claim 18, in which said fastening means comprises:

(a) adjustable strap means secured at one end of each of said arm pieces proximate said large diameter opening for extending across the back of said individual and connecting said arm pieces to one another; and (b) a hook attached to one end of each of said leg pieces proximate said large diameter opening for securing over the pants worn by said individual.

11. The costume of claim 18, in which said covering material of each of said arm pieces and leg pieces is a two-ply material comprising an inner layer and an outer layer, said outer layer consisting of a transparent material, and further comprising a helically wound tube of luminescent material embedded between said inner and outer layers along with said resiliently flexible wire material, said helically wound tube of luminescent material being visible through said outer transparent layer.

12. The costume of claim 9, in which said covering material comprises a reflective, silver-colored material.

13. A costume to be worn by an individual over conventional street clothes including pants and a shirt, said costume comprising:

(a) a pair of arm pieces, each of said arm pieces including,

I. A compressible tubular conduit defining a large diameter opening for loosely encircling an arm of said individual, said conduit being formed from a helically woulnd coil of resiliently flexible wire material and a covering material for encasing said coil of wire material, and II. an end cap provided on one end of said arm piece opposite said large diameter opening, said end cap including a planar surface extending transverely with respect to the longitudinal extent of said arm piece, said planar surface acting essentially as a stop for preventing said coil of wire material from extending beyond the length of said individual's arm, said planar surface further defining a small diameter opening for closely encircling said individual's wrist; and (b) a pair of leg pieces, each of said leg pieces including I. a compressible tubular conduit defining a large diameter opening for encircling a leg of said individual, said conduit being formed from a helically wound coil of resiliently flexible wire material and a covering material for encasing said coil of wire material, and II. an end cap provided on one end of said leg piece opposite said large diameter opening, said end cap including a planar surface extending transversely with respect to the longitudinal extent of said leg piece, said planar surface acting essentially as a stop for preventing said coil of wire material from extending beyond the length of said individual's leg, said planar surface further defining a small diameter opening for closely encircling one of said individual's shins; and (c) fastening means attached to each of said arm pieces and leg pieces for securing said arm pieces and leg pieces over said individual's body.

14. The costume of claim 21, further comprising linking means mounted on the end cap of each of said arm pieces for detachably linking said individual in continuous, arm-to-arm relationship to another individual wearing the same costume, said linking means being substantially co-planar with said end cap.

15. The costume of claim 22, in which said linking means comprises a strip of woven fabric hook and loop material.

16. The costume of claim 13, in which said covering material is a two-ply material comprising an inner layer and an outer layer, said outer layer consisting of a transparent material.

17. The costume of claim 16, further comprising a helically wound tube of luminescent material embedded between said inner and outer layers along with said resiliently flexible wire material, said helically wound tube of luminescent material being visible through said outer transparent layer.

* * * * *